United States Patent [19]

Robertson

[11] 4,175,993

[45] Nov. 27, 1979

[54] ARTICLE DECORATING MACHINE AND METHOD

[75] Inventor: Elmer L. Robertson, Overland Park, Kans.

[73] Assignee: Ethyl Development Corporation, Baton Rouge, La.

[21] Appl. No.: 849,803

[22] Filed: Nov. 9, 1977

[51] Int. Cl.[2] ..... B65C 3/12

[52] U.S. Cl. ..... 156/234; 101/7; 101/8; 101/38 A; 101/426; 156/233; 156/277; 156/387; 156/540; 156/542; 156/567; 156/582; 156/583.1; 156/DIG. 11; 156/DIG. 33

[58] Field of Search ..... 156/446, 542, 582, 583, 156/581, DIG. 25, DIG. 26, 363, DIG. 13, DIG.11, 567, 566, 540–541, DIG. 18, DIG. 27, DIG. 33, DIG. 42, DIG. 9, 233, 234, 384, 386, 385, 387; 214/1 B; 198/803; 101/38 R, 38 A, 36, 37, 11, 7, 8, 9, 426

[56] References Cited

U.S. PATENT DOCUMENTS

| | | | |
|---|---|---|---|
| 2,739,531 | 3/1956 | Hagerman | 156/DIG. 25 |
| 2,751,701 | 6/1956 | Grupe | 101/11 |
| 2,981,432 | 4/1961 | Flood | 156/567 |
| 2,984,337 | 5/1961 | Couch et al. | 156/DIG. 25 |
| 3,261,734 | 7/1966 | Long | 156/542 |
| 3,411,439 | 11/1968 | Moes et al. | 101/38 R |
| 3,718,517 | 2/1973 | Berg | 156/540 |

FOREIGN PATENT DOCUMENTS

| | | | |
|---|---|---|---|
| 927147 | 5/1963 | United Kingdom | 156/DIG. 18 |

*Primary Examiner*—Michael W. Ball
*Attorney, Agent, or Firm*—Donald L. Johnson; J. F. Sieberth; E. Donald Mays

[57] ABSTRACT

A method and apparatus for applying indicia to the surface of generally cylindrical articles. The machine utilizes a rotary article transport assembly or turret mechanism which has a plurality of gripper hands mounted thereon for holding the cylindrical articles to be decorated. At least one article orienting station is provided to orient the article so that the indicia is applied over the proper portion of the surface of the article. After orienting, the article is rotated in a holding assembly and the indicia carrying tape or foil is pressed against the appropriate portion of the outer surface of the article by a heated die carried on a cylindrical drum mounted immediately adjacent to the article being decorated. Means are provided for rotating the article being decorated and the die carrying drum at the same peripheral surface speed. Also, means are provided for positively feeding the decorating tape between the bottle and the transfer die.

16 Claims, 16 Drawing Figures

ARTICLE DECORATING MACHINE AND METHOD

BACKGROUND OF THE INVENTION

1. Field of the Invention

This invention relates generally to an apparatus and a method for applying indicia and decoration to generally cylindrical articles, more particularly, the application of indicia or decoration from metallic or pigmented leaf by hot stamping or the application of preprinted transfer decorative designs by heat transfer.

2. Description of the Prior Art

Currently, many articles are decorated or have indicia applied to their surfaces by means of hot stamping using a roll leaf foil and a heated die carrying the appropriate decoration or indicia which transfers that portion desired from the roll leaf foil to the article being decorated. Roll leaf hot stamping foil generally consists of a carrier strip of plastic, for example, a polyester film, onto which various release, protective, and adhesive coatings are applied, including the application of of a vacuum metallized layer or a pigmented layer, e.g., aluminum, gold pigment or silver pigment.

In the process employing transfer decoration, the particular decorative design desired is applied at intervals to a carrier tape or foil, again a suitable plastic film or paper carrier may be used. The design is created by conventional rotagravure printing techniques, silk screening, and/or other well known design creating techniques. The heat transfer decoration is applied to the article being decorated by impressing a hot surface on the back of the carrier tape causing the release coating to disengage the preprinted decoration and heating the decorative indicia to a temperature sufficient to fuse the adhesive coat on the rear face of the label to the article being decorated.

Each of the foregoing methods of decoration are finding increasing use in decoration of many articles, in particular, they have found widespread use in the decoration of cylindrical containers for consumer products such as bottles, tubes, vials, cosmetic stick cases and numerous other cylindrical or semicylindrical or non-cylindrical articles. Heretofore, there have been developed numerous methods and apparatuses for hot stamping or heat transfer decorating of generally cylindrical articles such as plastic bottles. One example of a hot stamping apparatus which has found extensive commercial use which utilizes a turret mechanism for feeding the bottles into a split mold type die holder for foil hot stamping is shown in U.S. Pat. No. 2,751,701. One of the disadvantages found in the machine described in the foregoing patent is the necessity of providing a preformed, split mold die holder which encases the article to be decorated and requires the roll leaf foil to be fed through the split die. The necessity of having a different split die holder for each different size or shape of bottle to be decorated adds to the complexity and expense of decorating different size and style bottles. Additionally, the bottles must be manually oriented and attached to the turret mechanism on this type of apparatus in order that the parting line of the bottle, in the instance where a cylindrical or generally cylindrical bottle is being decorated, is oriented so that the hot stamp indicia will not cross either of the horizontal split mold parting lines present on the outer cylindrical surface of the blow molded plastic bottle. This hot stamping machine also requires the use of large hydraulic or pneumatic cylinders and linkages for closing the split die carriers and the use of high pressure air for expanding the bottle against the foil and heated die to make a good transfer of the indicia on the die through the foil onto the plastic bottle.

Other patents exemplifying the art wherein rotary feed mechanisms are utilized to deliver plastic articles to either hot stamp foil or transfer label carrier decorating strips and their associated dies are shown in U.S. Pat. Nos. 2,981,432; 3,058,514; 3,411,439; and 3,718,517. Many of the foregoing decorating devices are limited in the size or shape, or both, of container which they are capable of decorating, some being applicable only to a particular shape and size of container. Other machines exemplified in these patents are extremely complicated mechanically and have limitations as to the amount of surface decoration that can be applied to plastic articles such as cylindrical plastic bottles. Additionally, some of these decorative applying machines do not provide positive orientation of the article being printed whereby printing across the parting lines of blow molded plastic bottles is avoided.

Therefore, it can be seen that there is a need for a hot stamping or transfer carrier decorating machine and method which overcomes many of the problems numerated above that are found in presently used devices.

SUMMARY OF THE INVENTION

It is an object of the present invention to provide a method and apparatus for decorating generally cylindrical articles which can decorate a wide variety of sizes and shapes of such articles.

A further object of the present invention is to provide a method and apparatus for decorating generally cylindrical articles which provides for precise location of the decoration on the article being printed.

Another object of the present invention is to provide a method and apparatus for decorating generally cylindrical articles which is capable of applying decoration to the article with high fidelity, i.e., little smearing or blurring of the edges of a hot stamp foil transfer.

It is an additional object of the present invention to provide a method and apparatus for decorating generally cylindrical articles which assures positive interaction between the article being decorated and the decorating foil and the die applying the indicia from the foil to the article.

The above and other objects of the present invention are realized in an apparatus for applying indicia to generally cylindrical articles which includes a support base for supporting the apparatus. A rotatable article transport assembly adapted for transporting a plurality of articles in a generally circular path is mounted on the base. An article holding device which is adapted to receive an article from the transport assembly and permit rotation of the article is provided. A cylindrical, rotatable die carrier drum is positioned above the article holding device. At least one die is mounted on the die carrying drum. Movable indicia carrying foil or tape is positioned between the article on the holding device and the rotatable die. Drive means are provided for rotating the article holding device and for rotating the die so that it comes into contact with one surface of the indicia carrying tape whereby the indicia is transferred to the surface of the article by the heated die.

Another embodiment of the present invention is found in the provision of a first orienting means for preliminarily orienting the article to be decorated prior to its movement to the final decorating station. Still another embodiment involves the provision of a second or final orienting assembly located at the position where the article is decorated which precisely orients the circumferential surface of the article to be decorated so that the die and transfer tape do not pass over one of the parting lines of the plastic bottle.

The foregoing and other objects, advantages and features of the invention will be more apparent from the following description when taken in conjunction with the accompanying drawings.

DESCRIPTION OF THE PREFERRED EMBODIMENTS

Figure 1:
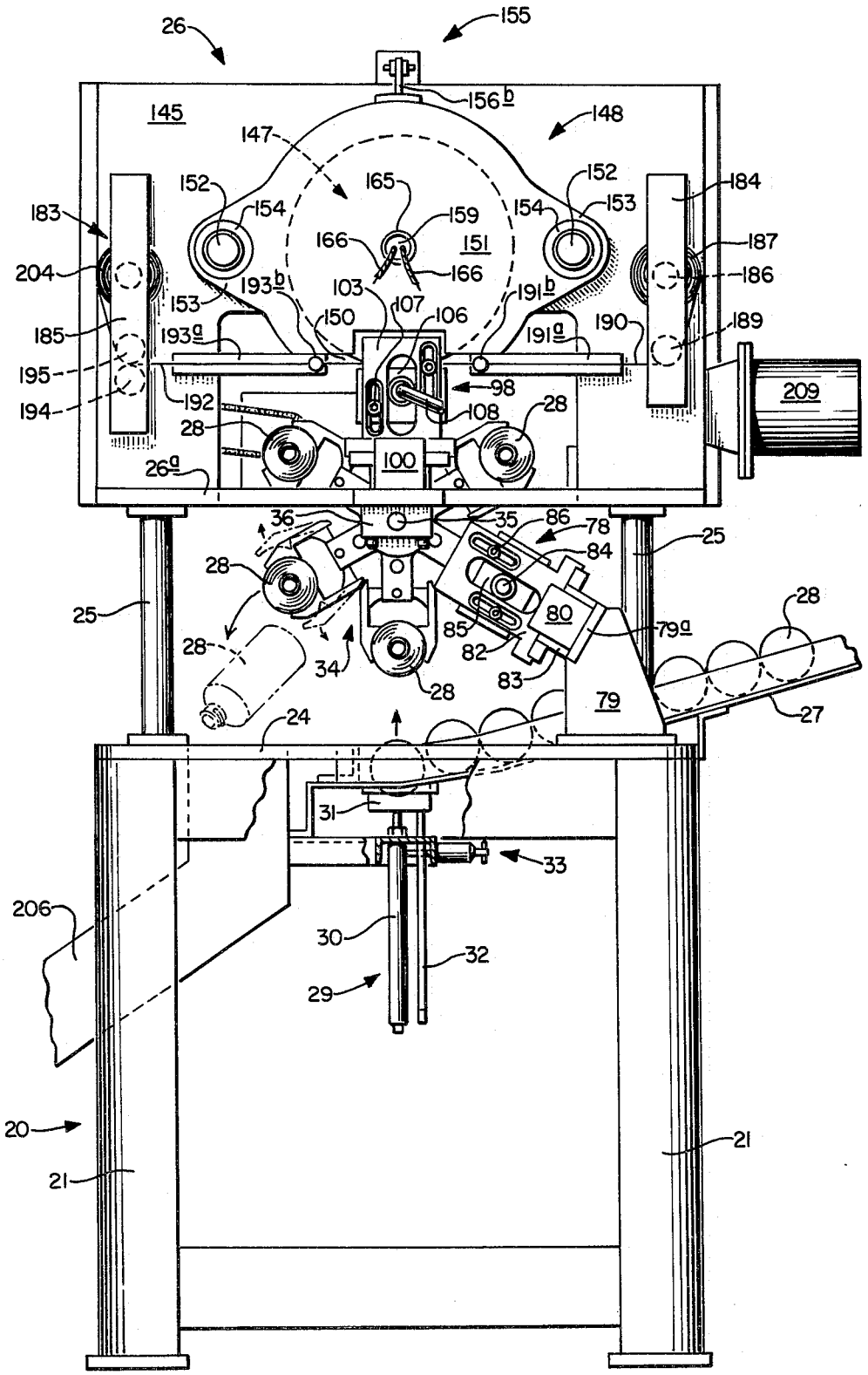
FIG. 1 is a front, elevational view of the indicia applying machine of the present invention.

Referring now to FIGS. 1-4 inclusive of the drawings, the decorating machine of the present invention includes a support base, generally designated by the numeral 20. The base includes four opposed, spaced apart leg members 21 and four pairs of upper brace members 22 and lower brace members 23 which connect the four spaced apart leg members together to provide a rigid structure. The support base also includes a top plate member 24. Four spaced apart support arms 25 have their bases affixed to the top of top plate member 24 and their upper ends attached to the upper support frame member designated generally by the numeral 26.

A conveyor trough, or chute 27 receives the article to be decorated from a supply source (not shown). The supply source may be a storage bin and a subsequent article orienter so that the articles are oriented in the proper direction as they are fed into the conveyor chute. While the article to be decorated may be any article which has a generally cylindrical form, e.g., open mouth jars, aerosol caps, open ended cylindrical tubes, aerosol containers, tubs and other like articles, the article depicted in the drawings for illustration is a Boston round plastic bottle 28. The forward end of the conveyor trough 27 and bottle elevator mechanism, designated generally by the numeral 29, is attached to the support base 20. The elevator mechanism includes an air cylinder 30 having a bottle cradle 31 mounted on the end of its piston shaft. A slotted guard member 32 is attached at its upper end to the bottle cradle 31 and has guide pin assembly 33 with a portion received in the slot to limit upper movement of the bottle cradle 31. By withdrawing the guide pin from the guide pin assembly 33, the cradle 31 and guard member 32 can be removed and different size cradles can be installed on the end of the air cylinder shaft for receiving different size bottles.

Figure 5:
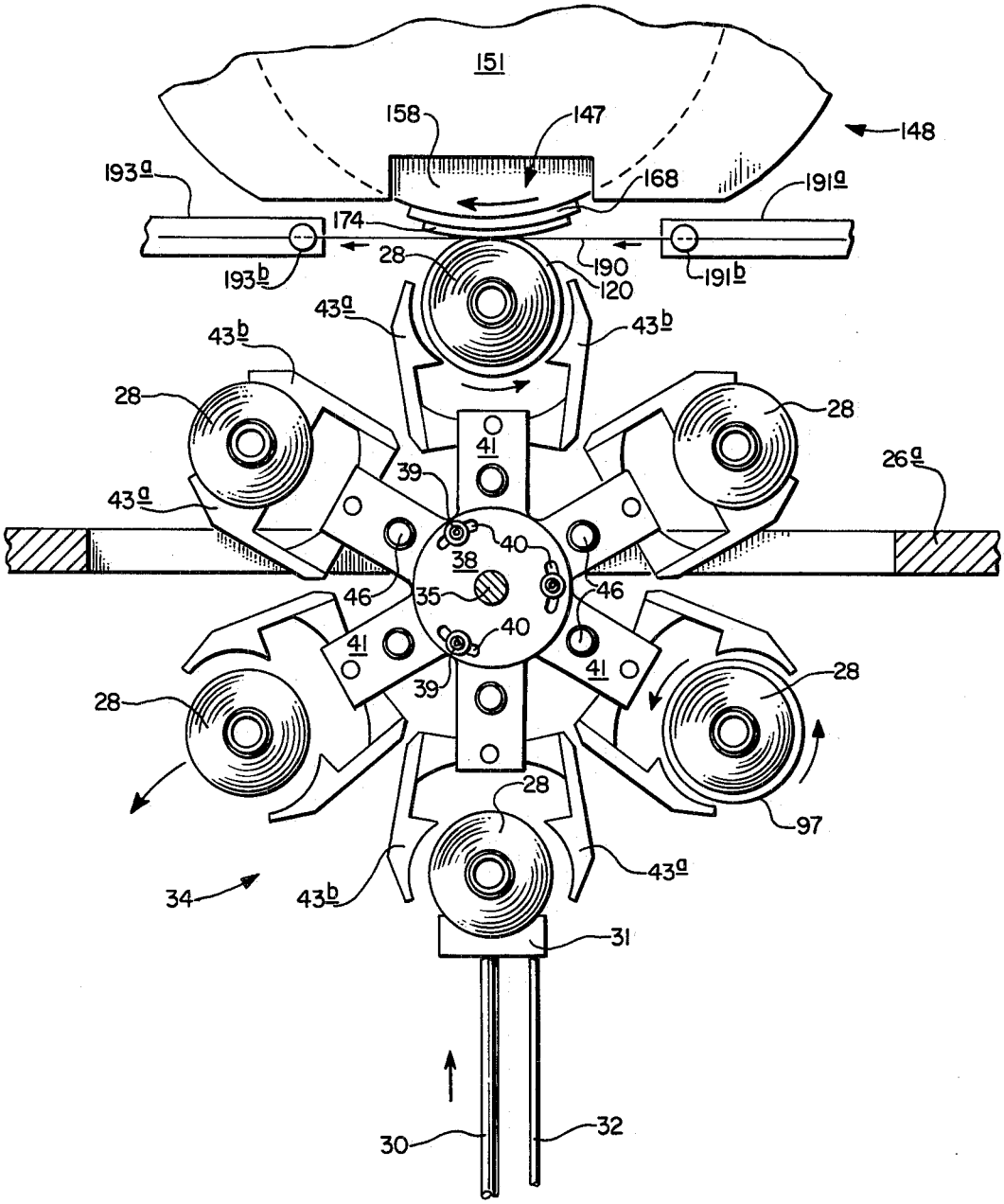
FIG. 5 is a partially sectional, enlarged, elevational view of the rotary turret or article transport mechanism of the present invention.
Figure 7:
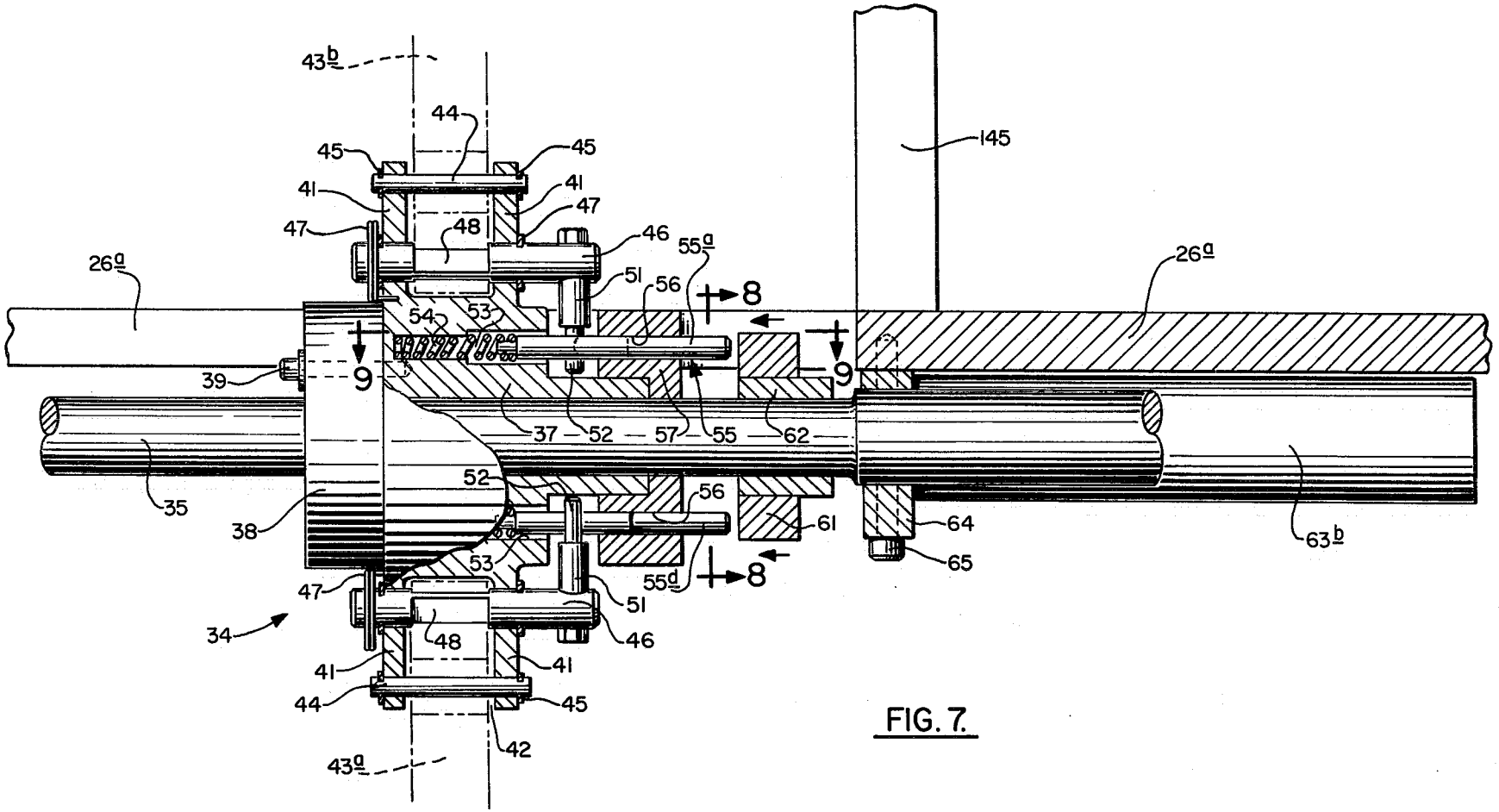
FIG. 7 is an enlarged, broken, partially sectional view of the gripper hands actuating mechanism portion of the rotary turret transport assembly.
Figure 12:
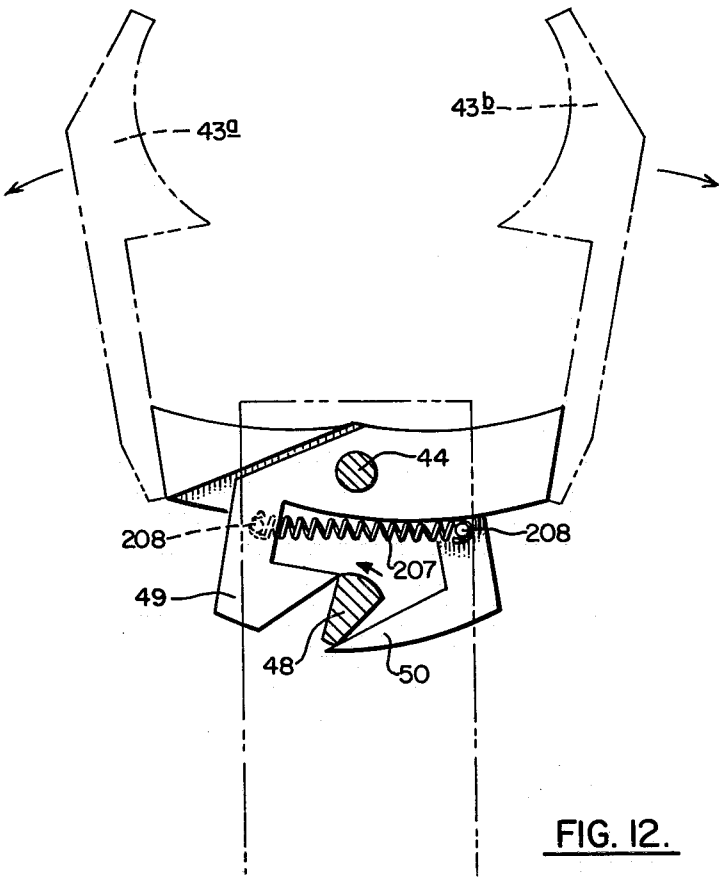
FIG. 12 is a view similar to FIG. 11 except showing the gripping hands in the open position.
Figure 11:
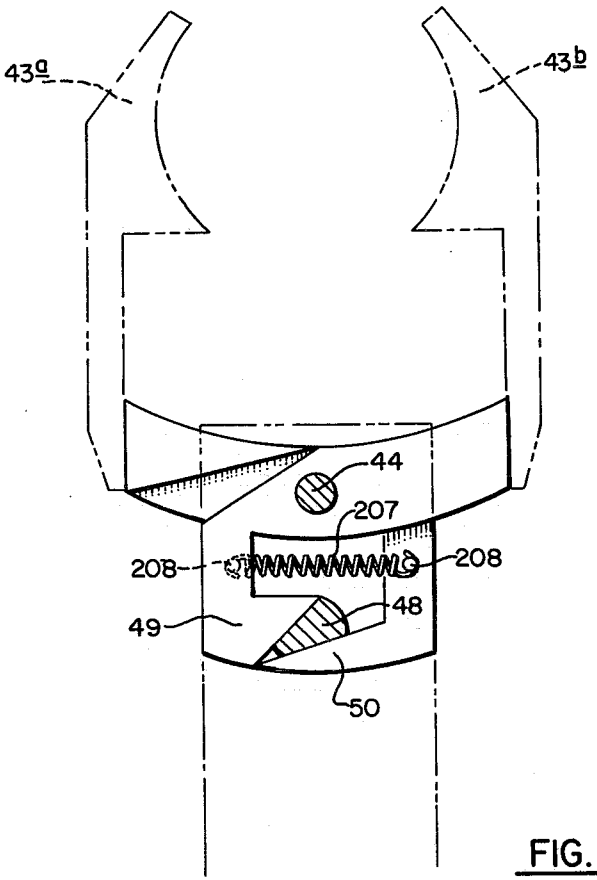
FIG. 11 is an elevational view of a pair of the gripping hands in the closed position showing their engagement with the camming arm at their lower ends.

Located immediately above the bottle elevator mechanism is the article or bottle transport or turret assembly, generally designated by the numeral 34. The transport assembly includes a shaft 35 rotatably journeled in bearing blocks 36 which are attached to the underside of lower plate member **26*a* of frame 26. Referring now to FIGS. 5 and 7, the transport assembly includes a wheel member 37 which is rotatably positionable on shaft 35 and is fixedly positioned thereon by means of attachment to collar 38 which is fixedly attached to shaft 35. The position of wheel member 37 can be radially adjusted on shaft 35 by means of locking bolts 39 received in slots 40 provided in collar 38. Wheel member 37 is provided with six identical equally radially spaced, outwardly extending mounting arms 41. Each of the mounting arms 41 is provided with a slot 42 therein which receives the lower ends of a pair of article or bottle gripping hands 43*a* and 43*b*. As seen in FIGS. 7, 11 and 12, the gripping hands 43*a* and 43*b* are pivotably mounted on pivot pin 44 mounted in opposed openings provided in the slotted mounting arms 41 and held therein by lock ring 45. A camming arm 46 is received in openings provided in the lower portion of each mounting arm 41 and is locked thereto by locking rings 47. The central portion of camming arm 46 is provided with a triangularly shaped beveled portion 48. The beveled portion 48 of the camming arm is received between the upwardly beveled end portion 49 of gripping hand 43*b* and the downwardly beveled lower end 50 of gripping hand 43*a*. The gripping hands 43*a* and 43*b* are normally maintained in the closed or gripping position shown in FIG. 11 by means of tension spring 207 having its ends attached to mounting pins 208 on the lower ends of the hands. One end of the camming arm 46 is provided with a transversely extending finger 51 which has a reduced lower end portion 52** thereon.

Figure 9:
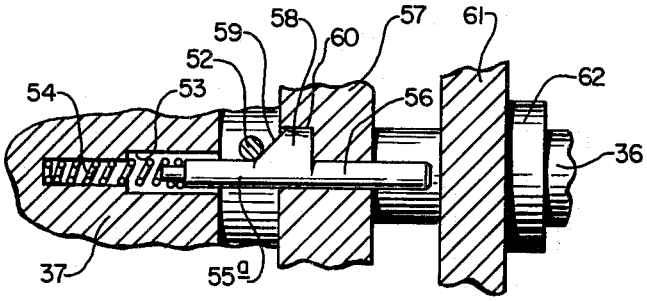
FIG. 9 is an enlarged, broken, partially sectional view of FIG. 7 taken along lines 9—9.
Figure 9A:
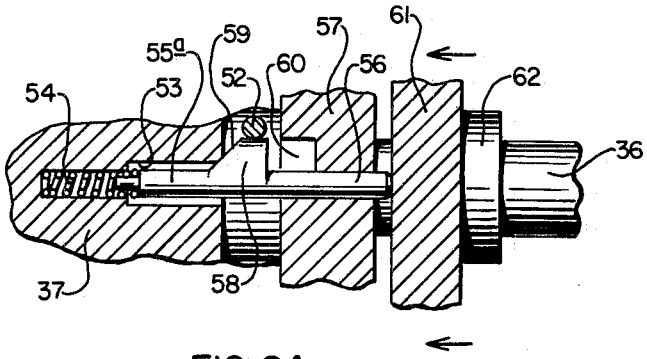
FIG. 9A is a view similar to FIG. 9 with the cam actuating pin shown in the position to open the gripper hands.

Referring now to FIGS. 7, 9 and 9A, the wheel member 37 is provided with an axial bore 53 immediately below each of the camming arms 46. A helical compression spring 54 is received in the bottom end of each bore 53. The inner end of cam pin 55*a, b, c, d, e* and *f* bears against the outer end of compression spring 54. The outer end of each of the cam pins is received in a bore 56 in a collar 57 that is press fitted on the end of wheel member 37. As seen more clearly in FIGS. 9 and 9A, each cam pin (55*a* being shown) has a transversely extending ear 58 at about its midsection. The transverse ear is provided with an angular front camming surface 59 which cams against the reduced end 52 of finger 51 as shown. Recesses 60 are provided in the collar 57 to receive each ear on the cam pins when the cam pins are in the outermost position.

Referring now to FIGS. 7, 8, 9, 9A and 10, a cam pin push plate 61 has a central opening therein which receives a press fitted, sliding sleeve 62 that is longitudinally reciprocal on shaft 35. Push plate 61 is reciprocated longitudinally along shaft 35 to make contact with the outer ends of the plurality of cam pins by means of a pair of spaced apart double-acting pneumatic cylinders 63*a* and 63*b*. The cylinders 63*a* and 63*b* have their inner ends attached to a generally rectangular, downwardly extending bracket 64 which is removably attached to lower plate member 26*a* by means of bolts 65—65. Each pneumatic cylinder 63*a* and 63*b* is equipped with a piston rod 66*a* and 66*b*, respectively, which have their ends projecting through openings (not shown) in bracket 64 and are fixedly attached to the back surface of the cam pin push plate 61 by suitable means, e.g., by being screw threaded therein or attached thereto by other suitable means.

Figure 8:
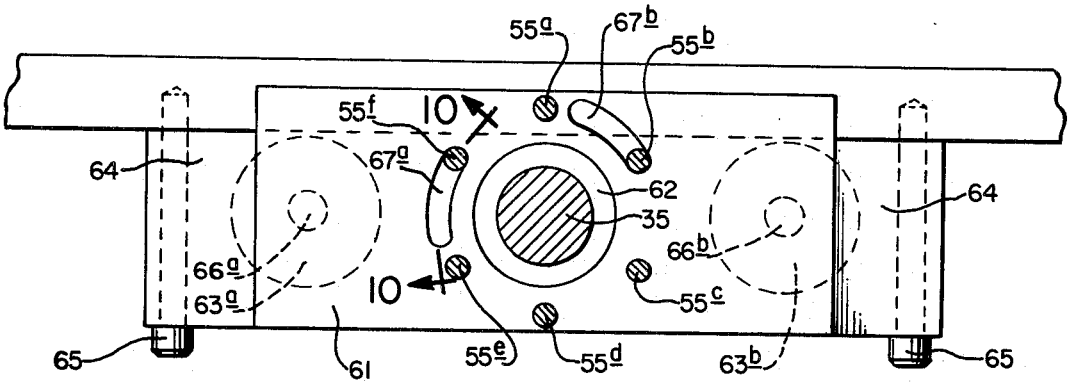
FIG. 8 is an enlarged, cross-sectional view of FIG. 7 taken along lines 8—8.
Figure 10:
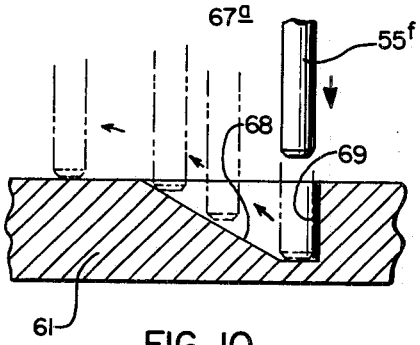
FIG. 10 is an enlarged sectional view of FIG. 8 taken along lines 10—10.

As seen in FIGS. 8 and 10, the front face of push plate 61 is provided with a pair of arcuate shaped downwardly tapering grooves 67*a* and 67*b*. Groove 67*a* is adapted to receive the end of cam pin 55*f* which is located at the 10 o'clock position and groove 67*b* is adapted to receive the end of cam pin 55*b* when viewing the arrangement of cam pins as seen in FIG. 8. As seen in FIG. 10, each arcuate recess 67*a* is provided with a downwardly sloping wall surface 68 which merges into a vertical end wall surface 69.

Referring now to FIGS. 5, 7, and 8, the pair of gripping hands 43*a* and 43*b* located at the 12 o'clock or bottle printing station position is actuated by means of cam pin 55*a*. A pair of gripping hands 43*a* and 43*b* located at the 2 o'clock or idle position station are actuated by cam pin 55*b* which is adapted to be received in slot 67*b*. The pair of gripping hands 43*a* and 43*b* located at the 4 o'clock position, the preliminary indexing station, is actuated by camming pin 55*c*. A pair of gripping hands 43*a* and 43*b* located at the 6 o'clock position, the bottle loading station, is actuated by camming pin 55*d*. The pair of gripping hands 43*a* and 43*b* located at the 8 o'clock or bottle release station is actuated by camming pin 55*e*. The pair of gripping hands located at the 10 o'clock or idle station is actuated by camming pin 55*f* which is adapted to be received in slot 67*a*.

Figure 2:
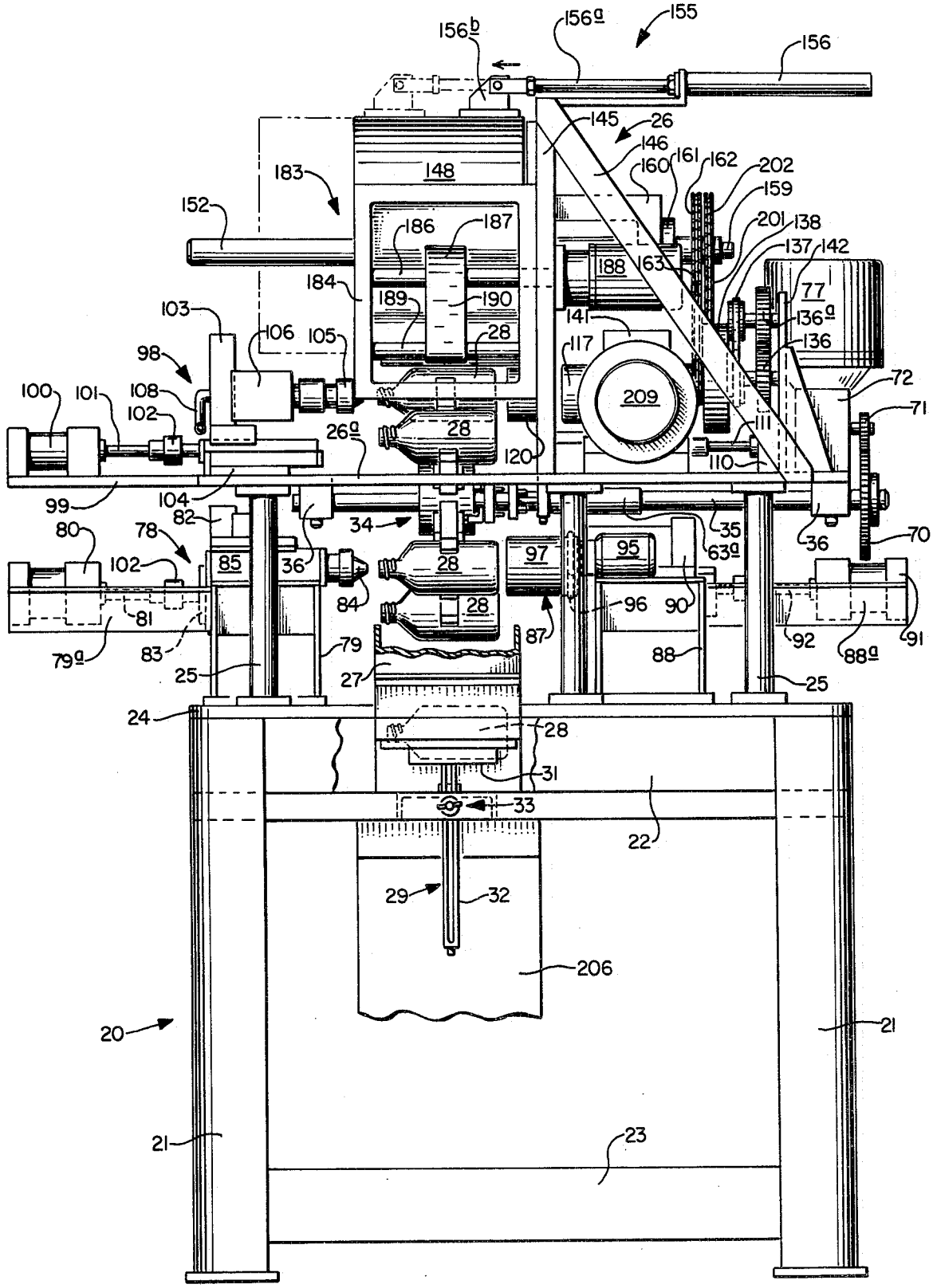
FIG. 2 is a right-hand-side, elevational view of the indicia applying machine of the present invention.
Figure 3:
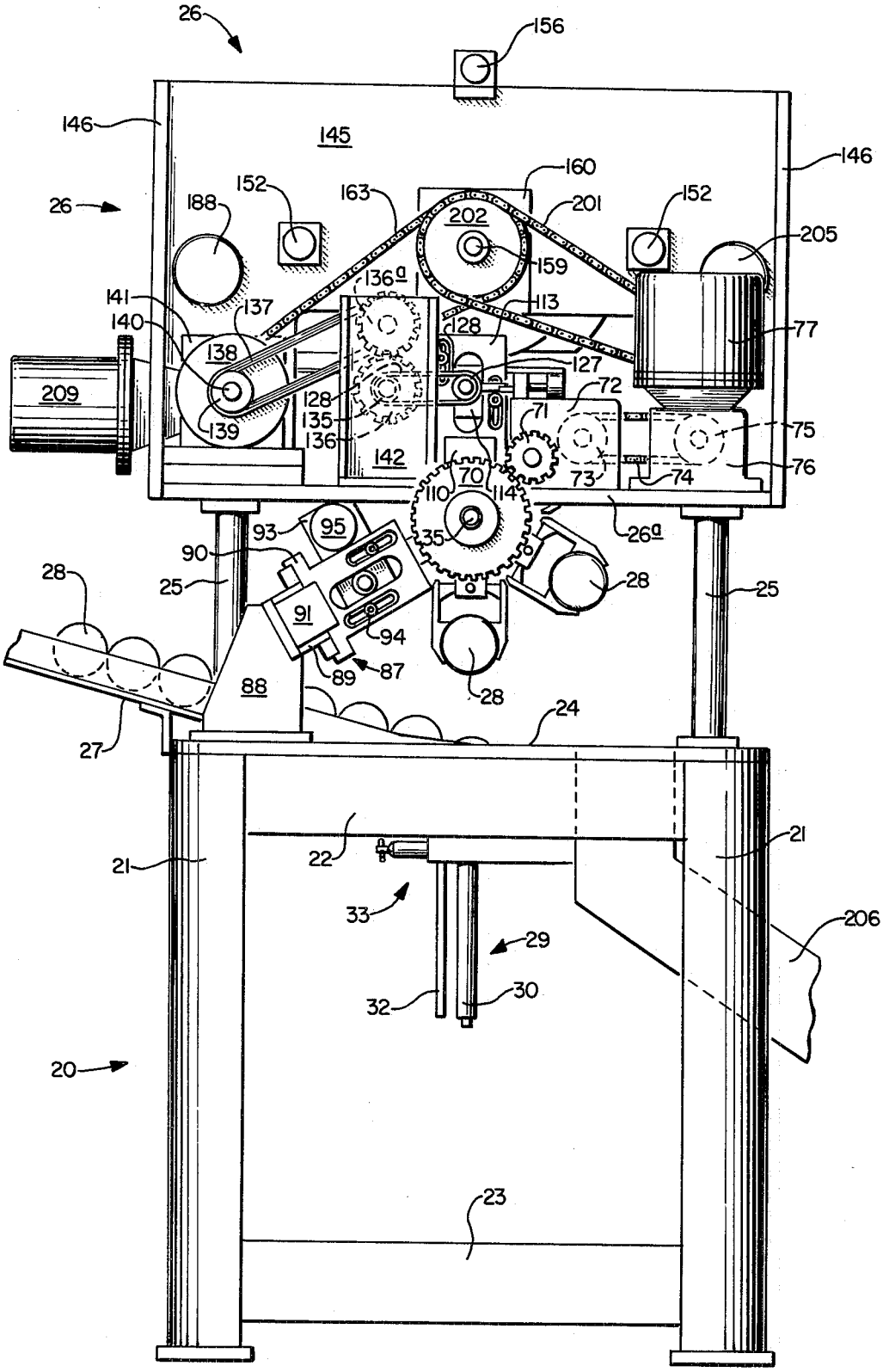
FIG. 3 is a rear, elevational view of the indicia applying machine of the present invention.

Referring now to FIGS. 2, 3 and 5, the article or bottle transport or turret assembly 34 is rotated in stepped increments of 60 degrees through a 360 degree path by stepped rotation of its transport shaft 35. Shaft 35 has affixed to its rearward end a toothed drive gear 70 which is, in turn, driven by meshing drive gear 71 that extends from the backside of electrical clutch 72. The clutch 72 is actuated by suitable cam timer and microswitch (not shown) to move the bottle transport or turret assembly through the six steps required to complete a 360° cycle of this assembly. Continuous drive power for the clutch 72 is supplied to clutch drive gear 73 by means of drive chain 74 driven by gear 75 which extends from the front side of gear reducer 76. Mounted on top of gear reducer 76 and providing the power therefor is electric drive motor 77.

Referring now to FIGS. 1, 2, 3 and 4, the front portion of the pre-orienting assembly, designated generally by the numeral 78, is mounted on bracket 79 which is affixed to the top of top plate member 24 by any suitable means. The front portion of the pre-orienting assembly 78 includes a double-acting pneumatic cylinder 80 attached to bracket extension 79*a*. Pneumatic cylinder shaft 81 is coupled to sliding block member 82 which is reciprocably mounted on base member 83 which is fixedly attached to the mounting bracket 79. A neck insert member 84 is rotatably received in mounting block 85 which is movably and adjustably attached to sliding block member 82 by means of set screws 86. Upon the application of pneumatic power to cylinder 80, neck insert member 84 moves forward to engage the neck of the particular bottle located at the 4 o'clock station, that is the pre-orienting station. As seen in FIGS. 1, 2 and 3, the rear portion of the pre-orienting assembly, designated generally by the numeral 87, is supported by bracket 88 attached to the top surface of top plate member 24 by suitable means. Attached to bracket 88 is base member 89 which slidingly supports sliding block member 90. Sliding block member 90 is reciprocal horizontally through actuation by pneumatic cylinder 91 through shaft 92 which has its inner end connected to the rear of sliding block member 90. Pneumatic cylinder 91 and the base block member (not shown) have support by means of bracket extension 88*a*. Motor and base cup mounting bracket 93 is attached to sliding block member 90 by means of set screws 94 received in slots provided in the mounting block for adjustment of the motor and base cup. Motor 95 is attached to the back side of bracket 93 and has a shaft (not shown) projecting therethrough with a pulley (not shown) thereon which drives belt 96 which rotates base cup 97 that is adapted to receive in its outer end the base of the bottle 28 that is held in the pre-orienting or 4 o'clock position. The base cup is provided with a rotatable outer member and an internal mandrel having a locater pin therein (not shown), all of which will be described in more detail later in connection with the final orienting assembly.

Figure 13:
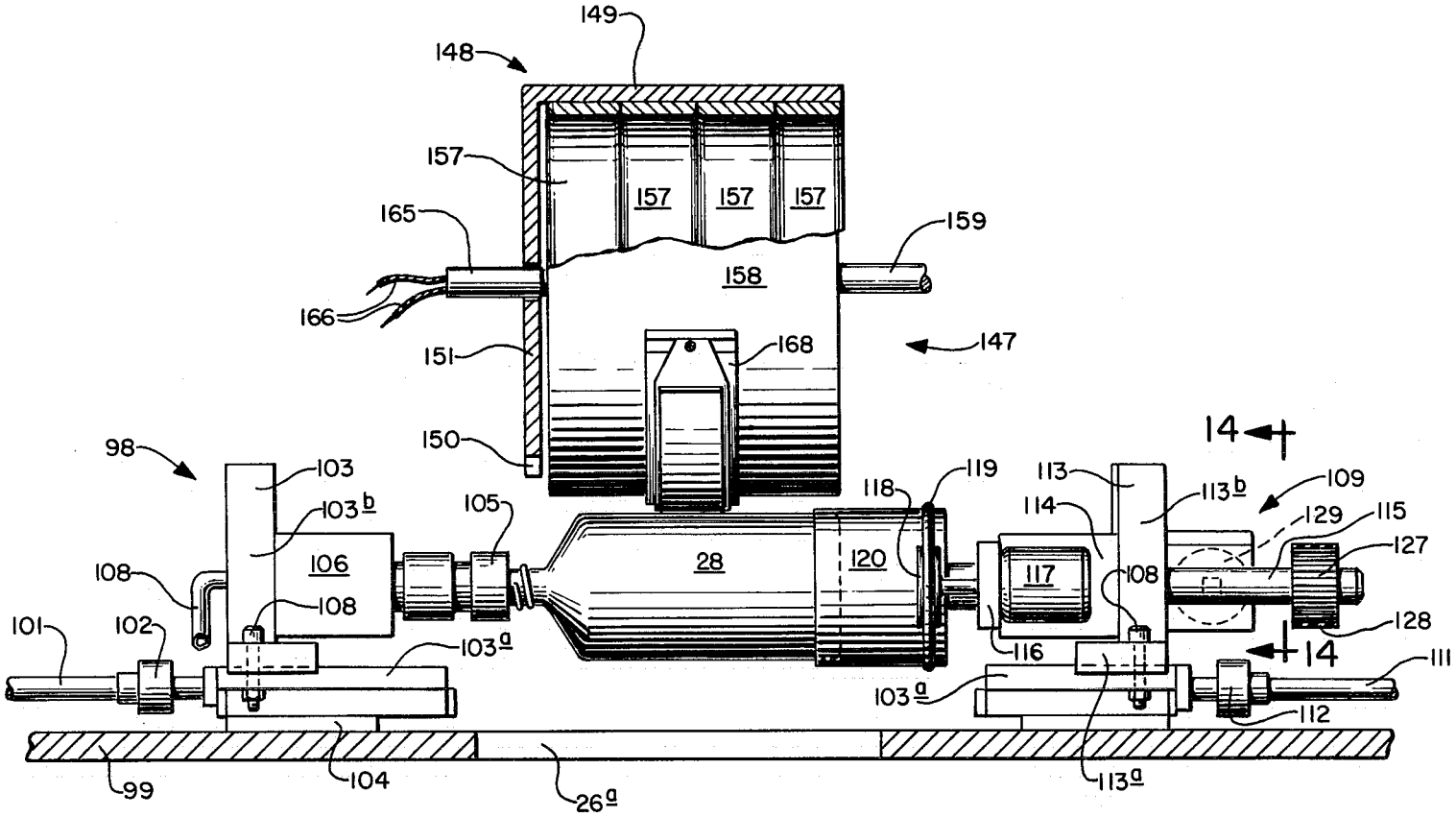
FIG. 13 is an enlarged, elevational view, partially in section, of the final orienting and bottle holding assembly, together with the die assembly, die carrier drum, and heater shroud assemblies.

A final orienting assembly is provided at the 12 o'clock or print station of the apparatus as seen in FIG. 5. Referring now to FIGS. 1, 2, 3, 4, and 13, the front section of the final orienting assembly, designated generally by the numeral 98, is mounted on the lower plate member 26*a* of the upper support frame 26. An extension bracket member 99 supports a doubleacting pneumatic cylinder 100 which has a forwardly extending drive shaft 101 attached through a coupling 102 to a sliding block member 103. The sliding block member is horizontally movable in fixed base block member 104. The sliding block member 103 and base block member 104 are provided with matching engaging V-shaped splines and grooves to provide accurate register and precise horizontal movement for the movable portion of the front section of the final orienting assembly. Neck insert member 105 is rotatably mounted in mounting block 106 which is adjustably attached to sliding block member 103 by means of set screws 107. The set screws are received in grooves provided in the walls of the sliding block member 103. The neck insert member 105 has a bore therethrough (not shown) to which is connected an air supply line 108 through which air is supplied to rigidify the bottle 28 as it is being printed. As seen in FIG. 13, if desired, the sliding block member 103 and 113 may be made in two sections, a base section 103*a* and 113*a* which are attached to an upstanding bracket sections 103*b* and 113*b* by means of bolts 108.

Referring now to FIGS. 2, 3, 13, 14 and 15, the rear section of the final orienting assembly is designated generally by the numeral 109. The rear section of the final orienting assembly includes a double-acting pneumatic cylinder 110 that is fixed to the lower plate member 26*a* of the upper support frame. The pneumatic cylinder has a forwardly extending shaft 111 that is attached by means of a coupling 112 to sliding block member 113. Sliding block member 113 includes slidable base section 103*a* and a vertical bracket section 113*b*. A base cup support block 114 is coupled to the front of the upstanding vertical bracket 113*b* by means of set screws 115 which are received in slots in the vertical bracket to provide adjustability of the base cup. Base cup support block 114 has a bore therethrough with a bearing therein (not shown) that rotatably receives the base cup drive shaft 115. A transverse motor mounting bracket 116 is attached to the base cup support block 114 and supports the base cup drive electric motor 117. The motor has a forward extending shaft and pulley 118 which engages an "O" ring type rubber belt drive 119 that, in turn, surrounds and rotatably drives the base cup 120.

Figure 15A:
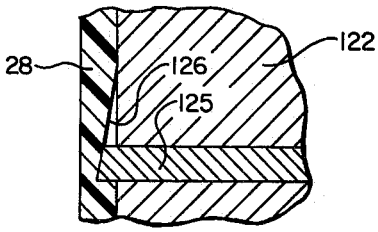
FIG. 15A is an enlarged view taken along the line 15A—15A of FIG. 15.
Figure 15:
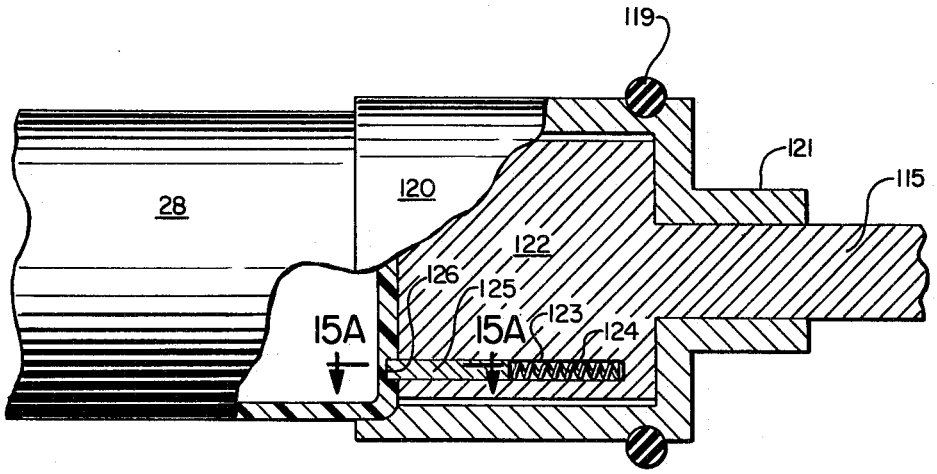
FIG. 15 is an enlarged elevational view, partially broken and partially in section, of the base cup and drive mandrel assembly of the final orienting device as shown in FIG. 13.

As seen in FIG. 15, the base cup 120 receives the lower end of the bottle in a lightly gripping fashion when the front section of the final orienting assembly is in the closed position as shown in FIG. 13. The base cup is provided with a rearwardly extending bearing section 121 which permits it to freely rotate on shaft 115. The inner end of shaft 115 is provided with an enlarged, generally cylindrical orienting mandrel 122 which can rotate independently of the base cup 120. The mandrel is provided with an offset bore 123 longitudinally aligned with the axis. The bore is provided with a compression spring 124 which has its outer end bearing against the inner end of detent pin 125 to bias the pin outwardly. Periodic rotation of shaft 115 provides for rotation of the bottle 28 through rotation of the mandrel 122 and pin 125 to coordinate the peripheral speed of the surface of the bottle with the printing tape and die speed as will be subsequently described.

As seen in FIG. 13, the end of drive shaft 115 is equipped with a grooved drive pulley 127 which is driven by a flexible, elastomeric lug belt 128.

Figure 14:
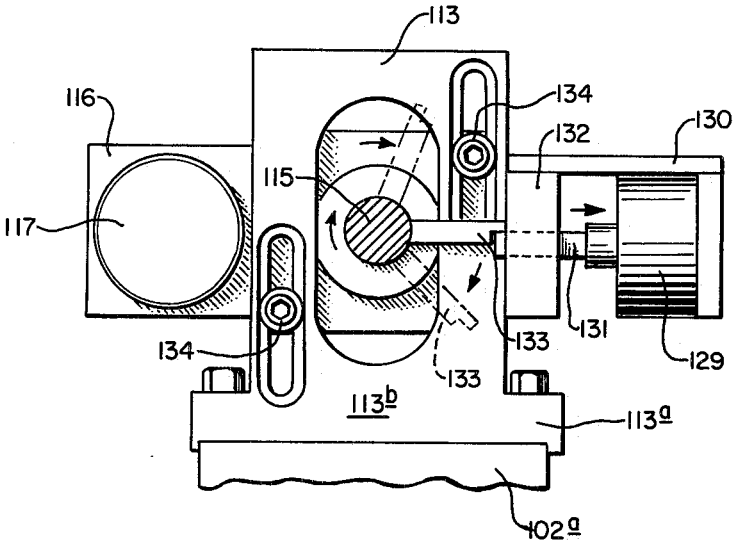
FIG. 14 is an enlarged view taken along the line 14—14 of FIG. 13.

As seen in FIGS. 3, 13 and 14, orienting mandrel drive shaft 115 has its cyclic rotation controlled by an electric solenoid 129 mounted on bracket 130. The solenoid is provided with a reciprocal shaft 131 which is slidingly received in a support block 132. The outer end of the shaft 131 is adapted to engage a transversely extending stop finger 133 that is fixedly attached to orienting mandrel drive shaft 115. Motor mounting bracket 116 and thus motor 117, shaft 115 and solenoid 130 can be moved as a unit since they are all attached to bracket 116 which is mounted to sliding block member 113 by means of bolts 134 received in slots provided in the vertical bracket 113*b*.

As indicated previously, the orienting mandrel drive shaft 115 is powered through each specific revolution to make the final orientation of the bottle 28 carried by the upper orienting mechanism by means of a pulley 127, flexible drive belt 128 which is attached to pulley 135 (see FIG. 3) that is driven by tooth gear 136 which meshes with like diameter upper tooth gear 136*a* which is, in turn, driven by flexible V-belt 137 that is attached to the outer drive shaft 140 of slip clutch 138 by means of V-belt pulley 139. Pulley 139 is driven by shaft 140 which extends from the right-hand side of gear reducer 141. The gear reducer is powered by electric drive motor 209.

Figure 4:
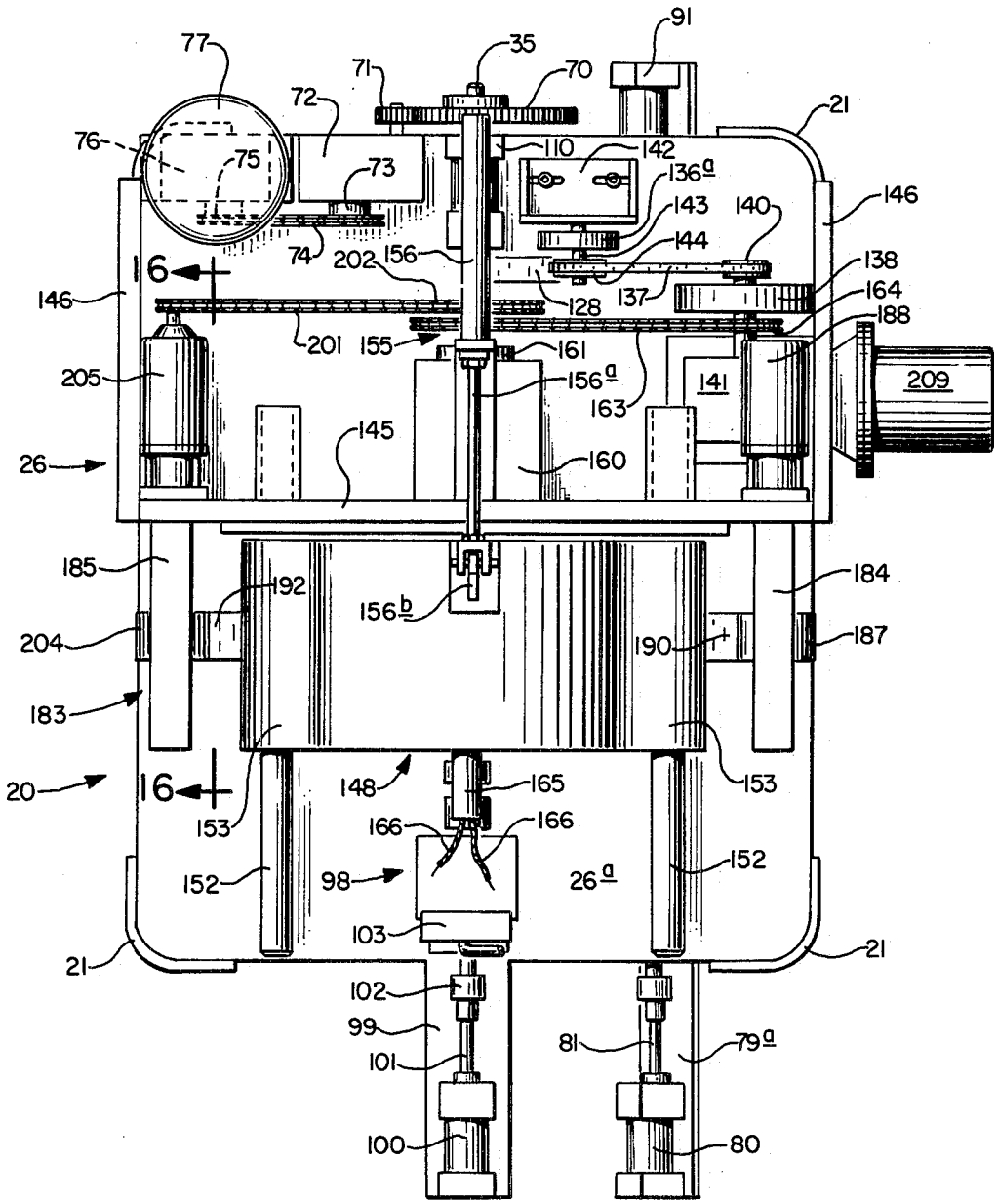
FIG. 4 is a top plan view of the indicia applying machine of the present invention.

Bracket 142 mounted on upper base support plate 26*a* provides mounting means for the shafts that carry intermeshing drive gears 136 and 136*a* and the associated pulleys attached to the outer ends of the shafts carrying these gears. As seen in FIG. 4, the upper tooth gear 136*a* is mounted on a rearwardly extending shaft 143 and carries on its outer end pulley 144 which receives the end of drive belt 137.

Upper support frame assembly, generally designated by the numeral 26, includes a vertically extending back mounting plate 145 as seen in FIGS. 1, 2, 3 and 4. The lower end of the back plate 145 is attached to the lower plate member 26*a* of the upper support frame by means of welding, bolting, or other suitable means and has its top edge attached thereto by means of cross braces 146—146 extending rearwardly from its top corner to the edge of lower plate member 26*a*. The back mounting plate 145 provides support for the die carrier drum assembly, designated generally by the numeral 147, and the die shroud heater assembly, designated generally by the numeral 148, which will be described in reference to FIGS. 1–4, 6 and 13. The die shroud heater assembly is a generally cylindrical, metal structure open at its rear end and having a generally cylindrical sidewall 149 which has a longitudinal open section 150 at its lower end and a solid end wall 151. The heater shroud 148 is mounted for longitudinal movement, as can be seen in FIG. 2, wherein in the normal position it completely surrounds the die carrier drum assembly 147, but can be moved horizontally to the left to completely uncover the die carrier drum as seen in dotted outline in FIG. 2. The heater shroud assembly is mounted for horizontal movement on a pair of opposed slide support arms 152–152, which arms have their rear ends threadedly, or otherwise fixedly mounted into back mounting plate 145. Sidewall 149 of the heater shroud is provided with two extended, thickened, generally cylindrical, integrally formed portions 153, which thickened portions are provided with a bore which tightly receives a sliding sleeve bearing 154 to permit the heater shroud to readily slide back and forth on support rods 152–152. A double-acting, pneumatic power assembly, designated by the numeral 155, provides the power for moving the heater shroud to cover or uncover the die carrier drum assembly as desired. This assembly includes a double-acting, pneumatically powered cylinder 156 and associated piston rod 156*a* which has its outer end attached to a bracket 156*b* that is fixedly attached to the top surface of the sidewall 149 of the heater shroud. As seen in FIG. 13, the interior of the heater shroud is provided with a plurality of generally cylindrical, electrical heater elements 157. These heater elements may be attached to the interior wall of the heater shroud by any suitable means, such as screws (not shown) or other means.

The die carrier drum assembly 147 includes a preferably solid, cylindrical, steel or other suitable metal cylinder 158. The cylinder for the die carrier assembly is rotatably mounted in the upper support frame 26 by means of a support shaft 159 which is preferably hollow at its front end. A bearing block (not shown) is provided on the wall of back mounting plate 145 and rotatably receives the shaft 159. A bracket 160 is mounted on the back side of mounting plate 145 and carries a bearing 161 which rotatably receives the outer end of the die cylinder support shaft 159. Sprocket gear 162 is fixedly attached adjacent the rear end of support shaft 159 and is directly driven by means of chain belt 163 attached to a sprocket gear 164 that is driven by a shaft extending from gear reducer 141. As seen in FIGS. 1 and 13, the front portion of support shaft 159 for the die cylinder 158, as previously indicated, is hollow and has a forward extension 165 which projects out through the forward wall 151 of the heater shroud and has extending therefrom thermocouple wires 166 which have their inner ends (not shown) placed at desired locations in contact with the dies, as will be subsequently described, which are carried by the cylinder 158.

Figure 6:
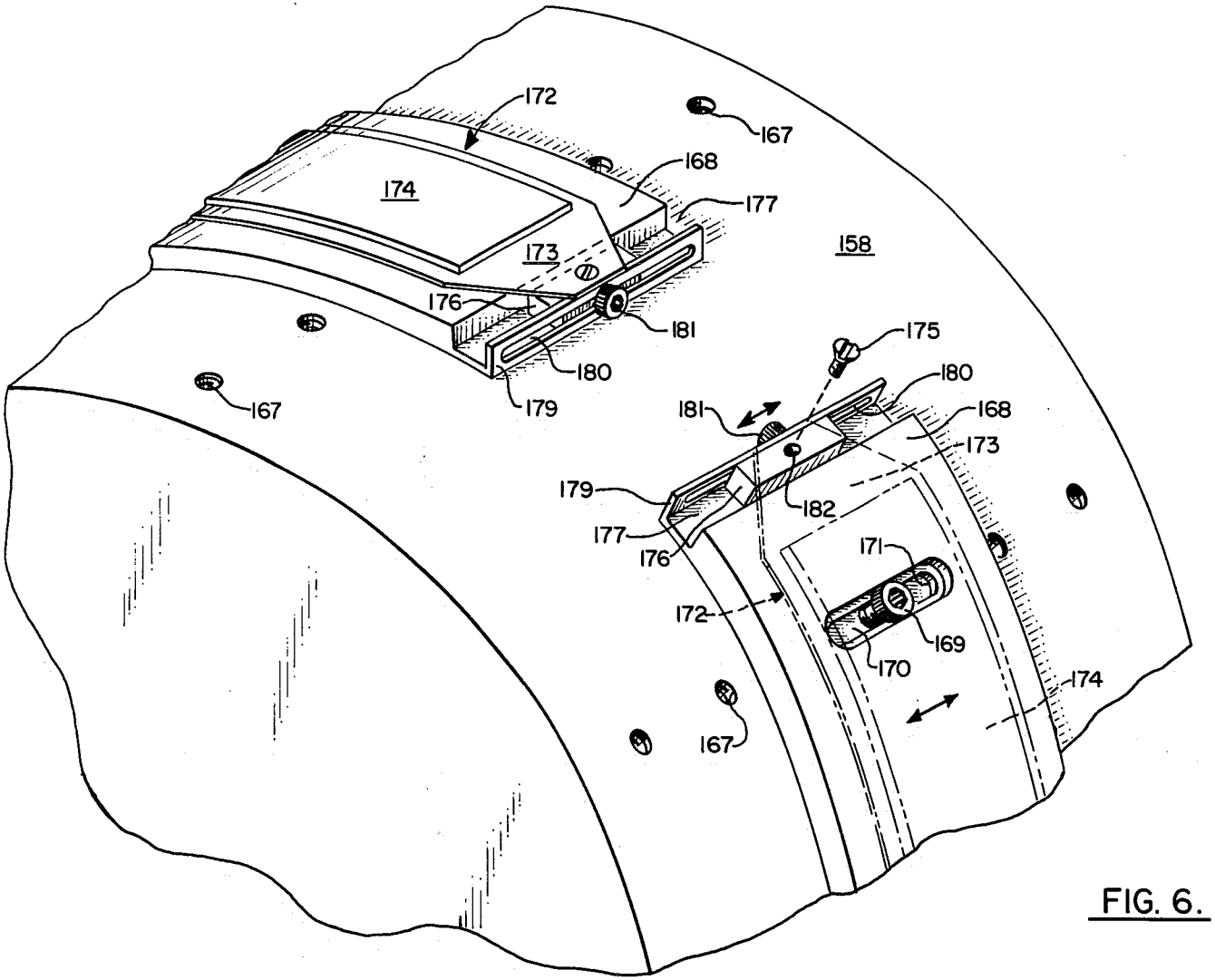
FIG. 6 is a broken, perspective, elevational view of the heater drum and die holders and die assembly of the present invention.

As seen in FIGS. 6 and 13, die carrier cylinder 158 is provided with a plurality of rows of tapped bolt holes 167 parallel to the longitudinal axis of the cylinder. Elongated, arcuately shaped die mounting plates 168 are attached to the outer surface of die carrying cylinder 158 by means of screws 169 received in the slot 170 which has a recessed shoulder 171 upon which the underside of the head of the allen screw abuts so it is recessed below the top surface of the die mounting plates 168. It will be understood that each end of each die mounting plate 168 is anchored by the same slot and screw arrangement. The individual hot stamping or label transfer die assembly, designated generally by the numeral 172, includes a thin, flexible metal mounting band or strip 173 which has bonded, by vulcanizing or other suitable means, to its upper surface the flexible die strip 174 which has the desired decorative motif or raised indicia on its outer surface. Preferably, the flexible die strips 174 are made from high temperature resistant, elastomeric material, for example, silicone rubbers. Each die strip is anchored at each of its ends to the die mounting plate by means of a flat head screw 175 received in an opening provided in the end of the die mounting band 173. A movable locking block 176 is received in a groove 177 which extends transversely across each end of each die mounting plate 168. The outer end wall 179 at the end of each mounting plate 168 is provided with a slot 180 which receives screw 181 that is threaded into sliding block 176 to fixedly position this block in any desired location within the slot 177. Block 176 is provided with a threaded tap 182 which receives the flat head screw 175 to lock the end of the die mounting strip 173 securely to the block. Thus, with the foregoing arrangement, it provides a dual arrangement for making changes in the position of the various hot stamping die assemblies 172 so that the hot stamping die 172 can be suitably positioned on the die carrier drum 147 to provide precise registery with the hot stamp tape or label transfer tape to insure very accurate registration of the indicia transferred to the surface of the bottle. Generally, it is preferred to have an individual die assembly for each bottle carried by the transport assembly.

Referring now to FIGS. 1, 2, 4, 5 and 16, a roll leaf foil or preprint label supply assembly, designated generally by the numeral 183, is attached to back mounting plate 145 by means of right-hand feed roll supply bracket 184 and left-hand takeup roll support bracket 185. Feed support bracket 184 supports rotatably a foil supply feed mounting spindle 186 which has mounted thereon a suitable roll of roll leaf stamping foil 187 or, alternatively, a roll of preprinted labels attached to a carrier strip. The rear end of mounting spindle 186 is attached to a low torque, D.C., stallable, tension control motor 188. Motor 188 is wired to rotate counterclockwise when viewed from the front of the machine so that it constantly applies a tensioning force to the feed roll 187 of foil in order that the foil will be fed between the die and the bottle surface under tension to assure high fidelity of printing of the indicia. The foil from the supply roll 187 passes under idler feed roller 189 and the strip of foil 190 passes through a slotted right-hand guide rod **191*b* which is supported by bracket 191*a* and is then tightly pressed between the surfaces of the moving hot die 174 and the rotating peripheral surface of the bottle 28, as can be seen in FIG. 5**.

Figure 16:
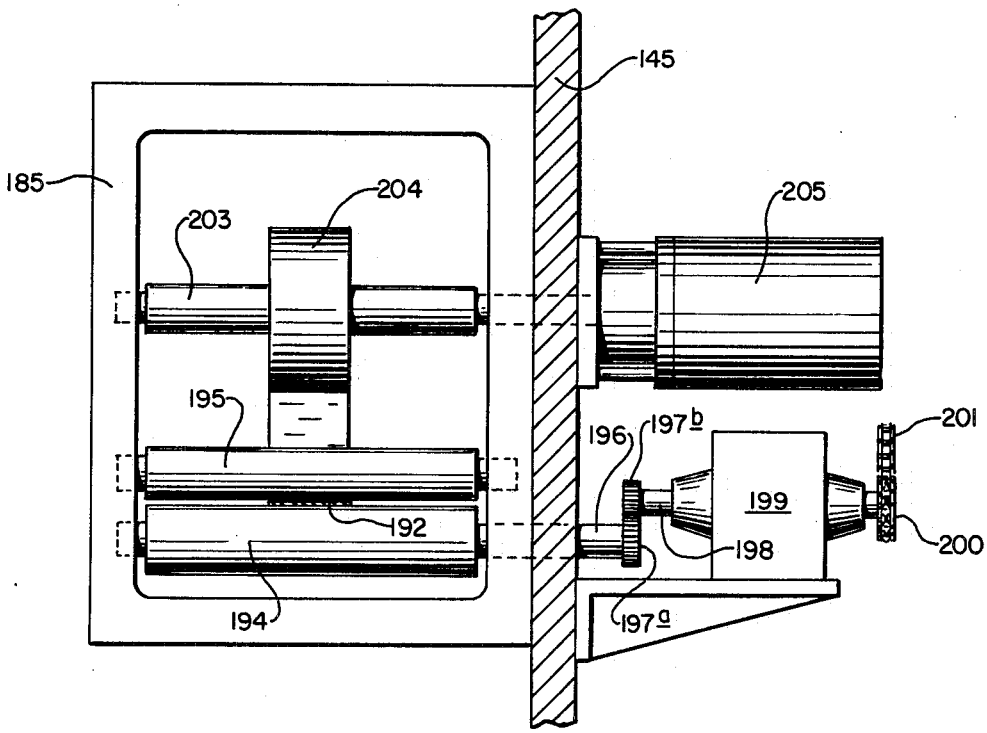
FIG. 16 is a view taken along the line 16—16 of FIG. 4.

After passage between the die and the bottle, the strip of waste foil 192, or waste tape if preprint labels are used, is fed through a slotted left-hand guide rod **193*b* which is supported by bracket 193*a*. As seen in FIGS. 1 and 16, after the waste tape 192 exits the left-hand guide rod 193*a*, the tape is received between two contacting rollers 194 and 195 which are rotatably mounted in left-hand foil feed support bracket 185. Lower roller 194 is positively driven by means of shaft extension 196 which is attached by meshing gears 197*a* and 197*b* to shaft 198 which extends from the left-hand side of speed reducer 199. Speed reducer 199 is driven by means of sprocket 200 extending from its right side. The sprocket 200 is connected to chain drive 201 which, in turn, has its other end connected to and driven by sprocket 202 which is mounted on the outer end of support shaft 159 for the die cylinder. Located above the positive drive waste foil takeup rollers 194 and 195 is a waste foil storage spindle 203 which accumulates the roll 204 of waste foil. Spindle 203 is positively driven in the clockwise direction (when facing the front of the machine) by means of a low torque D.C. electric motor 205** which can operate continuously in the stalled or semistalled condition without damage.

Use of the foregoing foil feed assembly provides for feeding foil or prelabeled tape into the interface between the die and the bottle surface where the foil or tape is always under tension and is always fed at exactly the same peripheral rate as the surface of the bottle and the die. Additionally, the positive drive connection between the takeup rolls 194 and 195 for the waste tape insure that the tape moves only when the die carrying drum moves since they are directly driven from the same positively connected power source.

While not shown, it is understood that a suitable rotary cam timing mechanism is provided which operates suitable electrical microswitches for proper sequential actuation of the double-acting pneumatic cylinders and electric solenoid members which are used to actuate the various moving components in the decorating apparatus of the present invention. A convenient source for driving a cam rack is shaft 159 which supports the heater drum. This shaft is constantly driven at a fixed speed by motor 142, gear box 141 and associated sprocket gear and drive chains so that a cam rack fixedly attached to the end of this shaft provides a constant speed, rotating power source for driving the shaft upon which the timing cams are mounted. Since such timing cams, microswitches and their interconnections are well known in the art, it is not felt necessary to unduly complicate the disclosure of the present invention by specifically reciting all of the elements, interconnections and manner of operation of well-known and suitable timing cam systems.

The method of operation of the decorating machine of the present invention will now be described based on the foregoing description of the construction of the machine. Any generally cylindrical article that is to be decorated is received in the inclined conveyor trough or chute 27 properly oriented for decoration. If the article is a hollow object, it will be necessary to orient the article so that the flat base of the article faces the rear of the machine and the open end of the article faces the front end of the machine. In the foregoing description of the construction of the machine, the exemplary article for decoration is a blow molded, Boston round, plastic bottle 28. These bottles may be conveniently oriented so that the neck portion is positioned toward the front of the machine and the flat base of the bottle is positioned to the rear of the machine by means of well-known orienting devices. However, if desired, the bottles can be manually removed from a storage container and placed in the conveyor trough 27 in the proper orientation by hand.

The bottle at the left-hand end of the line of bottles in the conveyor trough 27 is received in the bottle cradle 31 and, at the appropriate signal given by the cam timing mechanism (not shown), pneumatic cylinder 30 is actuated raising the cradle 31 to position the bottle within the open set of gripping hands **43*a* and 43*b* which are located at the loading station which is the station at the six o'clock position, as seen in FIG. 5. When the bottle 28 is being received in between the open hands 43*a* and 43*b* at the six o'clock loading station, the article or bottle transport assembly 34 is in a rest or stop position. In this particular position, the hands at the loading station are open to receive the bottle being held by the elevator mechanism 29; the next pair of hands to the right, those in the 4 o'clock position, are open and the pre-orienting assembly 78-87 is closed so that the bottle is rotatable for pre-orienting by this assembly. The bottle being held in the hands located on the turret at the 2 o'clock position are closed so that the bottle at this station is merely in a hold position and is not having any operations performed thereon. The bottle 28 positioned at the 12 o'clock or print station is being gripped between the front portion of the final orienting assembly 98 and the rear portion 109, as may be seen more clearly in FIG. 13, while the hands are open so the bottle may be first finally oriented and then rotated while in this position to be printed. The bottle in the 10 o'clock position is being held tightly between the gripper hands and is at an inactive station where no further operations are performed thereon. The bottle 28 that is located at the 8 o'clock station is being released by the open hands 43*a* and 43*b* located at this station so that the bottle is dumped into the receiving chute 206, as seen in FIG. 1**.

Following a bottle through the six incremental 60° steps which the turret mechanism goes through, the mounting arm 41 on wheel member 37 of the transport assembly at the 6 o'clock position closes its gripping hands **43*a* and 43*b* on the bottle 28 and the elevator assembly 29 retracts to the position shown in FIG. 1 and the guard 32 then permits the next bottle to roll onto the cradle 31 when it is in the down position. A turret drive mechanism then steps the arm counterclockwise 60° to place the bottle in the pre-orienting or 4 o'clock position. The bottle at this position is received grippingly between the front and rear pre-orienting assemblies 78 and 87. The hands then open and the bottle is oriented by the pre-orienting assembly, to be described in detail later, to preliminarily register the portion of the surface of the bottle desired to be either hot stamped or have the label applied thereto when it arrives at the hot stamp or labeling station at the 12 o'clock position. After the bottle is pre-oriented, the hands 43*a* and 43*b* at the 4 o'clock station close and grip the bottle, and the front and rear pre-orienting assemblies retract, and the transport assembly then indexes another 60° counterclockwise to bring the bottle to the rest or hold position at the 2 o'clock location. Each time the bottle is moved a 60° increment, another bottle is being sequentially loaded into the mounting arm and gripping hands which are located at the 6 o'clock position or loading station. The bottle next moves to the printing station located at the 12 o'clock position for the article transport asssembly where the front section 98 and the rear section 109 of the final orienting assembly close to grip the bottle and then the hands 43*a* and 43*b* open to permit the bottle to be rotated counterclockwise as seen in FIG. 5. After the bottle is finally oriented by the final orientation assemblies, the appropriate hot stamp die assembly approaches the bottle, and, at the instant contact is made with the hot stamp foil or label tape 190 by the first indicia carried by the hot stamp die, the bottle is positively rotated at the appropriate peripheral speed, and the tape is moved at the same speed which also matches the peripheral speed of the driven hot stamp die carried by the die carrier drum. The pre-orientation and final orientation of the bottle position the bottle in respect to the hot stamp die so that the indicia is impressed exactly over the area of the surface of the bottle desired to be hot stamped or have the preprinted label attached thereto. After the indicia has been applied to the bottle and the hot stamp die passes off the printing tape, the gripping hands 43*a* and 43*b* at the 12 o'clock or printing station close on the bottle, the orienting assemblies 98 and 109 retract, and the bottle is then moved 60° by the transport assembly to the holding or idle 10 o'clock station. After the next loading, pre-orienting, orienting and printing cycles are completed, the turret bottle transport assembly then rotates another 60°, and the printed bottle 28 is released by the hands holding it at the 8 o'clock station, and it is dropped into the takeaway chute 206**.

Referring now to FIGS. 2, 3, 4 and 7, the bottle transport or turret assembly 34 is moved in 60° increments in a counterclockwise direction, when viewed facing the front of the machine as shown in FIG. 1. The turret drive mechanism includes a constant speed drive motor 77 whose power is delivered through an electric clutch mechanism 72 which, periodically upon signal from the proper camming mechanism and microswitch, actuates the drive gear 71 which meshes with the master drive gear 70 that is mounted on the end of the transport drive shaft 35. The timing cam for the clutch mechanism 72 is appropriately adjusted so that the turret assembly 34 is rotated when the orienting and pre-orienting assemblies are in their open position, as seen in FIG. 2, and when the die-carrying drum 158 is moving through a position where space exists between the successive hot stamping dies so that there is no smearing of the indicia on the printed bottle as it is moved from the 12 o'clock print position to the 10 o'clock position where it is at rest. While the turret mechanism is shown as having 6 arms and sets of gripping hands, it may be equipped with more or less, depending on the need.

Referring now to FIGS. 5 and 7–12, the six sets of gripping hands 43*a* and 43*b* are opened and closed at the appropriate times and positions by a pneumatically actuated opening and closing mechanism. As seen in FIGS. 1 and 3, the bottle transport assembly 34 is in the position wherein it is gripping all six bottles carried by this mechanism and is ready to rotate the bottles through a 60° increment to position each bottle at the next station. When the turret or transport assembly is in the mode for revolving or in the act of revolving through the 60° arc, the actuating mechanism for operating each set of the gripping hands 43*a* and 43*b* is in the position shown in FIGS. 7, 8, 9 and 11. As seen in FIGS. 7 and 8, a pair of double-acting air cylinders 63*a* and 63*b* have pulled back the cam pin push plate 61 by means of the connection through piston rods 66*a* and 66*b* to the retracted position shown in FIG. 7. In this position, the outer ends of all six cam pins 55*a* through 55*f* are out of contact with the cam pin push plate, thus permitting shaft 35 to rotate and move the bottles through the 60° stepped increment while the gripping hands are firmly gripping all of the bottles carried thereby. In order to conduct the necessary operations on the bottles carried by the transport mechanism which are positioned at the 12 o'clock, 4 o'clock, 6 o'clock and 8 o'clock positions, it is necessary that the gripping hands located at these positions open to free the bottle from contact therewith so that the bottle at the 12 o'clock position can be finally oriented and then hot stamped while, at the same time, the bottle at the 4 o'clock position is freed from the gripping hands for pre-orienting by the pre-orientation assembly while the bottle at the loading station at the 6 o'clock position is raised by the loading elevator into the open hands of the turret mechanism at this position and so the completely printed and ready-to-eject bottle located at the 8 o'clock position can be freed. Also, it is necessary that the bottles remain firmly gripped in the gripping hands at the 2 o'clock and 10 o'clock positions since these are idle and/or intermediate transport positions where no movement of the bottle is required. To effect the opening of the gripping hands at the 12 o'clock, 4 o'clock, 6 o'clock and 8 o'clock positions, the cam push plate 61 is moved forward by the action of air cylinders 63*a* and 63*b* and the outer surface of the push plate makes contact with the cam pins located at the foregoing 12, 4, 6 and 8 o'clock positions, i.e., cam pins 55*a*, 55*c*, 55*d* and 55*e*, as seen in FIG. 9A as an example. When the gripping hands 43*a* and 43*b* are in the closed or gripping position, as seen in FIG. 11, the appropriate cam pins are in their full rearward position, as shown in FIG. 9, wherein the transverse ear 58 is received in the slot 60 provided in collar 57. In this position, the reduced end 52 of finger 51 is resting against the intermediate round portion of the cam pin immediately adjacent the lower end of the beveled camming surface 59 on the ear 58. When the cam pin push plate 61 moves forward, the reduced end 52 of the transverse finger 51 rides up the beveled camming surface 59 to the top thereof, as shown in FIG. 9A. As seen in FIGS. 7, 11 and 12, when the finger 51 on the camming arm is arcuately rotated, this rotates the camming arm 46 which, in turn, tilts the central beveled portion 48 of the camming arm that is received between the matching and contacting beveled lower end portions 49 and 50 of the gripping hands 43*b* and 43*a*, respectively. As this central portion of the camming arm rotates, it forces these lower end portions apart, as seen in FIG. 12, pivoting the gripping hands 43*a* and 43*b* over the pivot pin 44 and expanding tension spring 207 which is held to the lower end of the respective camming arms by pins 208—208 to open the gripping hands on each of the mounting arms located at the 12, 4, 6 and 8 o'clock positions. The camming pins 55*b* and 55*f* located at the 2 o'clock and 10 o'clock positions are received in tapered slots 67*a* and 67*b*, as shown in FIGS. 8 and 10. When the cam pin push plate 61 moves forward, these two pins are fully received in the arcuate recesses 67*a* and 67*b* and no forwrd movement of these pins occurs, thus the gripping hands carried on the mounting arms 41 at these two positions remain closed, and the bottles at these stations remain securely gripped while the machine is stopped. In the event of malfunction of air cylinders 63*a* or 63*b* or any of the actuating components therefor, e.g., air supply, timing cams, electrical solenoid valves, etc., the bottle transport assembly 34 can rotate through a 60° arc without damage to pins 55*f* and 55*b* which are received in the respective recesses 67*a* and 67*b*. As the turret mechanism rotates clockwise, the respective cam push pins 55*f* and 55*b* will ride up the sloped surface 68 of each of the recesses, thereby pushing these pins clear of the recess and permitting them to slide over the surface of the push plate 61 without shearing off or bending the ends of these pins. Should this occur, the gripping hands at these two locations, i.e., the 2 o'clock and 10 o'clock position, will open dropping the bottles from the arms immediately signaling the operator that there has been a malfunction in the assembly for actuating the gripping hands. After the respective bottles have been printed at the 12 o'clock station, pre-oriented at the 4 o'clock station, and loaded at the 6 o'clock receiving station, the push plate is retracted by the double-acting air cylinders 63*a* and 63*b*. The respective compression springs 54 force each of the cam pins rearwardly until the respective ears 58 engage the bottom of their respective recesses 60 of the collar 57 thereby closing all of the gripping hands on the bottle in readiness for the next 60° indexing step of the transport assembly.

The operation of the assembly for final orienting and holding of the bottle while printing takes place will now be described with reference to FIGS. 2, 3 and 13–15A. As seen in FIGS. 2 and 13, the final orienting assembly includes a front section assembly 98 which has a double-acting pneumatic cylinder 100 which moves a sliding block member 103 rearwardly when the bottle transport assembly 34 is moving from one stop position to the next. This stop position of the machine is shown in FIG. 2. After the turret mechanism has positioned the bottles in their proper stop position, the cylinder 100 is actuated and moves the sliding block member forward so that the neck insert member 105 enters the neck of the bottle, as can be seen in FIG. 13. Simultaneously therewith, the rear section of the final orienting assembly 109 is actuated by means of double-acting pneumatic cylinder 110, and sliding block member 113 moves forward carrying therewith the base cup 120 which encompasses and lightly, frictionally receives the bottom portion of the bottle 28, as can be more clearly seen in FIG. 15. This sequence is carried out by means of appropriate camming gears driving suitable timing switches which actuate solenoid valves for supply of air through the pneumatic cylinders, as in conventional. When the bottle is firmly gripped in the final orienting assemblies 98 and 109, motor 117, which is continuously driven, drives the cup base 120 through belt 119 and moves the bottle 28 rotatively clockwise, as viewed from the front, until the detent 126 in the bottle receives the detent pin 125. During this time interval, the orienting mandrel 122 carrying detent pin 125 is immobilized by means of shaft 115 being held against rotation through engagement of stop finger 133 with the shaft 131 on solenoid 129 which is in the outer or extended position. When this engagement is in effect, the flexible belt 128 stops driving the shaft 115 by virtue of its connection through matching bevel gears 136 and 136*a* and V-belt 137 to the slip friction clutch 138 which stops driving pulley 140, thus allowing the drive assembly for the shaft 115 to halt during this period. Once detent pin 125 engages the bottom of the detent 126 in the bottle 28, the bottle is immediately stopped from rotating in the preselected position wherein it will be oriented peripherally properly so that the hot stamped indicia will be applied by the hot stamp die over the precise area selected for receiving the hot stamping. It is essential that the area selected for receiving the hot stamped indicia not include either of the two opposed, 180°-apart parting lines that are normally present in plastic bottles which are blow molded using a mold having split mold halves, i.e., hot parison blow molded bottles. The final orienting device is adapted to precisely locate the peripheral area of the bottle in relation to the bottle parting lines to avoid printing thereover and to precisely locate the area desired to be printed so that it is coordinated with the hot stamp die as it transfers the indicia from the hot stamp foil to the selected surface area of the bottle. Another reason that it is essential to provide precise orientation of the area to be printed on the bottle with the hot stamp die is to permit repetitive hot stamping of the same bottle where different portions of the decoration or indicia are applied in different colors in multiple passes of the same bottle through the machine.

The base cup 120, as indicated before, is only lightly, frictionally in contact with the bottom of the bottle 28 and cannot overcome the engagement of the detent pin 126 of the bottle 28. Therefore, no further clockwise rotation of the base receiving cup and bottle is permitted since the mandrel carrying the detent pin is locked against any rotation at this time. At the precise proper time when the hot stamp die 172 is in position to begin contact with the hot stamp foil 190, and thus initiate printing on the bottle, the bottle is under full control of and will be driven by the positive drive assembly which drives the orienting mandrel 122. When the hot stamp die leading edge comes into contact with the printing foil and printing is to start, the positive drive mechanism for driving the mandrel, which, in turn, drives the bottle at the same peripheral speed as that of the arcuate-shaped hot die assembly and the same linear speed as the tape 190, is initiated by actuating the electrical solenoid 129 to pull pin 131 from under stop finger 133 thereby permitting the mandrel drive shaft 115 to rotate at the preselected speed by means of the drive assembly previously described. The clutch 138 will then actuate the mandrel drive chain, and the bottle will be driven counterclockwise by virtue of engagement of the detent pin 125 being seated in the detent 126 in the bottle and the free rotation of the neck member insert 105 in its mounting block 106. After the complete indicia is applied to the positively driven bottle 28 located at the printing station, the turret or transport mechanism is actuated to close the gripping hands on this and the other bottles as previously described. The turret mechanism then indexes 60° before the next successive die arrives at the printing position and the final orientation of the following bottle occurs prior to the leading edge of the following hot stamp die approaching the hot stamp printing foil. The foregoing sequence is successively repeated for each bottle that is rotated by the turret assembly into the printing station or the 12 o'clock position.

The operation of the pre-orienting station assemblies 78 and 87, as seen in FIGS. 1–4, is substantially the same as the final orientation station, with the exception that the bottle received in the pre-orienting station is rotated only by means of the base cup 97 being driven by the drive motor 95 when the base cup and neck insert member 84 are gripping the bottle therebetween. Upon signal from suitable timing cams, the pneumatic cylinders 80 and 91 actuate the forward mounting block to move the neck insert 84 into the neck of the bottle and to move the base cup 97 into the base of the bottle. A fixed, non-rotating mandrel (not shown) is retained in base cup 97 and is provided with an outwardly extending insert pin (not shown) similar to that described in connection with the final orienting base cup. The base cup 97 rotates the bottle 28 clockwise (as seen in FIG. 5) until the detent in the bottom of the bottle engages the fixed pin in the fixed mandrel. Then the bottle is immediately stopped in the desired, preselected position determined by the location of the parting lines on the bottle and the area desired to be printed on the periphery thereof. At this time, the light frictional engagement between the base cup 97 and the bottle 28 is sufficient to stop both the base cup at the time the bottle stops and the drive motor 95 which is for selected low torque so that it stalls and remains in the stopped condition until the bottle is gripped by the gripping hands and the pre-orienting assembly is retracted, and the bottle is moved up from the 4 o'clock pre-orienting position to the 2 o'clock idle position.

The pre-orienting assembly and final orienting assembly are designed for changing a minimum of components in order that the bottle decorating machine can accommodate bottles, or other articles to be decorated, of widely varying lengths and diameters. To change the machine from a shorter or longer bottle that has been previously run, it is only necessary to change out the coupling lengths in the air cylinder shafts and/or moving the base block members or the respective neck insert and base cup holding assemblies. Additionally, the neck insert members can be readily changed since they can be sized to have the same shaft diameters for reception in the respective mounting blocks. A suitable number of different diameter base cups and mandrel assemblies can be provided for bottles of different base diameters. As can be seen in FIGS. 11 and 12, the gripping hands 43*a* and 43*b* which are carried by the arms 41 of the bottle transport assembly may be made separately from the lower portions which can then be left permanently attached to the arm assemblies 41. The separate upper hands can be attached to their permanent lower section by bolts received in threaded, taped holes provided in the lower sections. These pairs of hands can be custom sized for any individual size bottle desired to be printed, and a various number of different sizes of these pairs of hands may be kept in stock to readily change the machine over for bottles of different diameters.

As seen in FIGS. 1–6 and 13, the die carrier drum assembly 147 is mounted on a rotating shaft 159 at the upper part of the machine and includes a drum 158 which is preferably solid metal for acting as a suitable heat sink. As previously explained, the cylinder 158 is provided with one or more hot stamp dies 172 which carry the indicia desired to be transferred to the bottle. As indicated before, the leading edge of each of the individual dies 174 is brought into contact with the hot stamp foil 190 that is interposed between the circumferential surface of the bottle 28 to be printed at the exact time that the bottle is positively driven so that there is uniformity established between the bottle surface speed, die surface speed and hot stamp tape linear speed. The die carrier drum 158, die mounting plate 168, die mounting strip 173 and the die 174 itself are kept at the appropriate temperature determined by the transfer characteristics of the metal foil tape used for hot stamping or the release coating on the preprint label carrying tape. The temperature of the heaters 157 carried by the shroud 149 is controlled by the thermocouples 166 which have their inner ends (not shown) located at suitable points to sense the temperature at the critical locations of the hot stamp dies and/or the drum. It is understood that the thermocouples 166 are attached to temperature controllers (not shown) which will control the power to the heater elements 157 to precisely control the surface temperature of the silicone hot stamp dies 174 or the flat silicone strips used for transferring preprinted labels. The cylindrical die carrier 158 is driven at a precisely selected speed which, as indicated hereinbefore, is coordinated with the hot stamping foil tape speed and the rotational speed of the bottle being printed and is driven through constant speed electric motor 209, associated reducer gear box 141, chain drive 163 and sprocket 162 attached to the shaft 159 of the die carrier drum 158.

As seen in FIGS. 1–4 and 16, the supply roll 187 of hot stamp foil and/or preprinted labels is kept under constant tension by means of stallable low torque motor 188 which attempts to turn counterclockwise. The foil is pulled under roller bar 189 and through slotted guide rod **191*b* into the space between the surface of the silicone hot stamp die carrying the indicia desired to be transferred to the bottle and the peripheral surface of the bottle. After the tape is used to transfer the indicia, the waste tape 192 is pulled through slotted guide rod 193*b* by means of driven roller 194 and matching press roller 195 so that it is taken up on waste takeup roll 204 which has a constant clockwise rotation force applied by low torque stallable motor 205. The tape is positively driven as described hereinbefore by rollers 194 and 195 by means of pulley 202 attached to the heater drum shaft 159 which is connected to speed box reducer 199** so that its speed is exactly coordinated with the peripheral speed of the bottle being printed and the die being pressed thereagainst.

From the foregoing, it can be seen that the present invention supplies a long felt need for a very versatile hot stamping or preprint label applying machine which is versatile and can be used to decorate a number of different size articles which have a generally cylindrical surface. The articles may even have a tapered surface such that part or all of the outer wall is generally conical. All that is necessary to decorate such articles is to utilize dies made on a taper so that they apply the indicia at the exact angle to match the surface angle of the portion of the bottle being printed. Thus, the articles may be conical, arcuately shaped, or have cylindrical sections of different diameter, it only being necessary that the die be sized and made on the proper angle for the area in which the indicia is to be applied.

While the above description is directed to one preferred embodiment of the invention, it is to be understood that other variations and modifications will be apparent to those skilled in the art and such variations and modifications may be made without departing from the spirit and scope of the present invention.

What is claimed is:

1. A method for applying indicia to the surface of a generally cylindrical article comprising:

(a) vertically elevating said article horizontally positioned and gripping the sidewall surface of said article at an article-loading station by gripping means carried by a rotating article transport assembly;

(b) rotating said article transport assembly about a horizontal axis to bring said article to a fixedly positioned, combined orienting and indicia transfer station;

(c) supporting said article for rotation about its longitudinal axis at said combined orienting and indicia transfer station;

(d) releasing said article from the grip of said gripping means;

(e) orienting said article to properly position the selected portion of the sidewall surface thereof for receiving the indicia by rotating said article with means fixedly positioned at said orienting and indicia transfer station;

(f) drivingly rotating said article on its axis while pressing a moving strip of indicia printing material between said selected portion of said bottle sidewall surface while contacting the other side of said strip with a hot die carrying the indicia to be printed on said article;

(g) stopping said rotation of the article after indicia transfer is completed and gripping the sidewall surface of said article by said gripping means;

(h) rotating said article transport assembly to bring said article to an eject station; and (i) opening said gripping means to release said article.

2. An apparatus for applying indicia to generally cylindrical articles comprising:

(a) article elevating means adapted to receive a horizontally positioned single article and to elevate said article in a direct vertical path to an article-receiving station;

(b) turret means mounted for rotation about a horizontal axis, said turret means having a plurality of radially extending, article-gripping means mounted thereon for gripping the sidewalls of a plurality of said articles;

(c) means for rotating said turret in incremental steps including rotating coupling means for directly applying power to said turret;

(d) means independent of said turret means for rotatively holding and orienting an article at an indicia-applying station;

(e) means for applying indicia to an article at said indicia-applying station after said article is oriented;

(f) means to simultaneously (i) open said gripping means to receive an article at said article-receiving station, (ii) release a gripped article after it is received by said holding and orienting means at said indicia-applying station, and (iii) release a gripped article at a discharge station; and (g) means to simultaneously close said gripping means at said article-receiving station and at said indicia-applying station to hold said articles securely while said articles are transported from said receiving station to said indicia-applying station and from said indicia-applying station to said discharge station.

3. In the apparatus of claim 2 wherein pre-orienting means is provided for pre-orienting said article by rotating at a pre-orienting station located between said loading station and said indicia-applying station.

4. In the apparatus of claim 3 wherein the article is a plastic bottle having a base and neck thereon and wherein:

(a) said pre-orienting means includes:
  (i) a horizontally movable and rotatable neck insert member adapted to be received in the neck of said bottle, and
  (ii) a horizontally mounted base cup rotatably attached to a non-rotating shaft having a locater pin extending therefrom, said base cup adapted to receive the base of said bottle and to rotate the same to engage the locater pin to stop rotation of the bottle in the desired pre-oriented position.

5. In the apparatus of claim 2 wherein said means for applying indicia includes die means and means for applying heat to said die means.

6. In the apparatus of claim 2 wherein:

(a) said means for applying indicia includes:
  (i) a cylindrical drum mounted for rotation about its horizontal axis,
  (ii) at least one die mounted on said drum,
  (iii) a generally circular heating shroud surrounding at least a portion of said drum and spaced therefrom for indirectly heating said die, and
  (iv) means for moving said shroud horizontally from over said drum whereby said die can be attached to and removed from said drum.

7. In the apparatus of claim 2 wherein said means for applying indicia to said article includes a heater shroud spaced from and partially surrounding a cylindrical die-carrying means and a die mounted thereon, said shroud containing radiant heaters on the interior surface thereof to indirectly apply heat to said die.

8. In the apparatus of claim 7 wherein:

(a) said die includes:
  (i) a die-mounting plate movably attached to said cylindrical die-carrying means,
  (ii) a die-mounting strip movably attached to said die-mounting plate, and
  (iii) a die-carrying indicia for application to said article fixedly attached to the surface of said die-mounting strip.

9. In the apparatus of claim 2 wherein the article is a plastic bottle having a base and a neck thereon and wherein:

(a) said means for orienting an article at said indicia-applying station includes:
  (i) a neck insert member horizontally movable and rotatably mounted for insertion into the neck of said bottles,
  (ii) a base cup adapted to receive the base of said bottle, said base cup being horizontally movable and rotatably mounted for positive rotation on its horizontal axis,
  (iii) a rotatable orienting mandrel received within said base cup and adapted for rotation independent of said base cup, and
  (iv) said mandrel being provided with an outwardly extended, spring-biased detent pin adapted upon rotation of said mandrel to engage a detent provided in the base of said bottle to rotate said bottle in synchronization with the means for applying indicia to said bottle.

10. An apparatus for applying indicia to generally cylindrical articles having an open end and a closed base comprising:

(a) an article elevator assembly including a cradle for receiving a horizontally positioned single article and a reciprocable shaft attached to said cradle for elevating said article in a direct vertical path to an article-receiving station;
(b) an article transport turret assembly mounted above said elevator, the turret assembly having a plurality of radially extending arms mounted on a shaft positioned for rotation about a horizontal axis, each of said arms being provided with a pair of openable and closable gripping hands adapted to open and close on the sidewall of each of said articles;
(c) a drive assembly for rotating said article transport turret through incremental steps including a cylindrical drive gear fixed to said shaft and a second intermeshing drive gear powered by a clutch mechanism having a motor coupled thereto;
(d) a common article-holding and orienting assembly fixedly mounted at an indicia-applying station, said assembly including a horizontally movable and rotatable neck insert for holding said open end of the article and a base cup horizontally movable and rotatably mounted for receiving the base of said article and rotating said article to its final oriented position, and a mandrel received in the base cup adapted to positively engage said base of said article and to rotate the same in synchronization with the application of indicia to said article;
(e) an indicia-applying assembly located above said article-holding and orienting assembly at the indicia-applying station adapted to apply indicia to said article after orientation thereof; and
(f) gripping hands opening and closing assembly adapted to open and close said gripping hands when they are located at said article-receiving station, at said article indicia-applying station, and at an article discharge station provided after said indicia-applying station.

11. The apparatus of claim 10 including tape supply and takeup assemblies and an independent drive assembly for positively moving the portion of said tape between said die and said article surface at the same speed as said die and said article outer surface.

12. The apparatus of claim 10 including a first article-holding and orienting assembly adapted to pre-orient said article by rotating said article, said assembly positioned between said article-receiving station and said indicia-applying station.

13. The apparatus of claim 12 wherein said first article-holding and orienting assembly includes a base cup adapted to receive the base of the article, said cup being rotatably mounted on a fixed mandrel having a spring-loaded detent pin therein adapted to engage an arcuate recess provided in the bottom of the article.

14. The apparatus of claim 10 wherein each of said pairs of gripping hands are pivotably mounted on each of said arms and are opened and closed by a camming arm received in between the lower ends of each pair of gripping hands, the camming arm being actuated by a cam pin slidably received in a wheel member mounted on said shaft, said cam pins being actuated by a push plate powered by pneumatic cylinders.

15. In the apparatus of claim 10 wherein said indicia-applying assembly includes:

(a) a cylindrical drum mounted on a rotatable shaft;
(b) at least one indicia-carrying die mounted on the surface of said drum;
(c) a heater shroud spaced from said drum for applying heat indirectly to said die;
(d) a tape-carrying indicia appliable material interposed between said article and said die; and
(e) an assembly for moving said tape through the interface of said die and said article surface.

16. In the apparatus of claim 10 wherein said gripping hands opening and closing assembly includes:

(a) spring means normally holding said gripping hands in the closed position;
(b) a camming arm for opening and closing each pair of gripping hands;
(c) a cam pin for actuating each of said camming arms;
(d) a push plate for engaging the outer ends of the cam pins; and
(e) power means for moving said push plate into and out of engagement with said cam pins.

* * * * *